US009908751B2

(12) United States Patent
Brzoska

(10) Patent No.: US 9,908,751 B2
(45) Date of Patent: Mar. 6, 2018

(54) TELESCOPIC BOOM AND CRANE

(71) Applicant: Liebherr-Werk Ehingen GmbH, Ehingen/Donau (DE)

(72) Inventor: Sebastian Brzoska, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 73 days.

(21) Appl. No.: 14/250,030

(22) Filed: Apr. 10, 2014

(65) Prior Publication Data

US 2014/0339188 A1 Nov. 20, 2014

(30) Foreign Application Priority Data

Apr. 11, 2013 (DE) ..... 10 2013 006 259

(51) Int. Cl.
*B66C 23/70* (2006.01)
*B66C 23/18* (2006.01)

(52) U.S. Cl.
CPC ..... *B66C 23/708* (2013.01); *B66C 23/185* (2013.01); *B66C 23/70* (2013.01); *B66C 23/705* (2013.01)

(58) Field of Classification Search
CPC ..... B66C 23/70; B66C 23/708; B66C 23/705; B66C 23/185
See application file for complete search history.

(56) References Cited

U.S. PATENT DOCUMENTS 1,345,304 A * 6/1920 Zied ..... B66C 23/36 212/204
2,819,803 A * 1/1958 Obenchain ..... B66C 23/36 182/2.11
2,975,910 A * 3/1961 Conrad ..... B66C 23/36 212/300
3,021,014 A * 2/1962 Korensky ..... B66C 23/70 212/177
3,029,954 A * 4/1962 Grant ..... B66C 23/36 212/114
3,080,068 A * 3/1963 Felkner ..... B66C 23/70 212/177
3,082,881 A * 3/1963 Wieger ..... B66C 23/66 212/350
3,085,695 A * 4/1963 Miller ..... B66C 23/70 212/177

(Continued)

FOREIGN PATENT DOCUMENTS

DE 20 2010 014 103 U1 3/2012
DE 20 2010 014 105 U1 3/2012

OTHER PUBLICATIONS

German Search Report Dated Jan. 14, 2014 w/ partial English translation (nine (9) pages).

*Primary Examiner* — Michael E Gallion
(74) *Attorney, Agent, or Firm* — Crowell & Moring LLP

(57) ABSTRACT

A telescopic boom for a crane has at least two telescopable telescoping sections in the form of lattice pieces, each of which exhibits a hollow structure that has in essence the shape of a box. The bottom chords of adjacent sections have in each instance a pinning structure to provide for pinning to each other during normal crane operations. By way of the design of at least the outer telescoping section, at least some of the force that is introduced into the pinned joint can be dissipated into the top chord of the boom.

15 Claims, 3 Drawing Sheets

(56) References Cited

U.S. PATENT DOCUMENTS 3,430,778 A * 3/1969 Brown ..... B66C 23/70 212/300
3,511,388 A * 5/1970 Markwardt ..... B66C 23/70 212/177
3,830,376 A * 8/1974 Fritsch ..... B66C 23/707 212/350
3,985,234 A * 10/1976 Jouffray ..... B66C 23/707 212/350
4,036,372 A * 7/1977 Rao ..... B66C 23/708 212/230
4,045,936 A * 9/1977 Sterner ..... B66C 23/707 384/35
4,053,058 A * 10/1977 Jensen ..... B66C 23/708 212/298
4,166,542 A * 9/1979 Bryan, Jr. ..... B66C 23/703 212/231
4,253,579 A * 3/1981 Williams ..... B66C 23/70 52/650.2
4,394,914 A * 7/1983 Privat ..... B66C 23/702 212/203
5,199,586 A * 4/1993 Pech ..... B66C 23/70 212/175
5,487,479 A * 1/1996 Pech ..... B66C 23/70 212/177
5,628,416 A * 5/1997 Frommelt ..... B66C 23/705 212/292
5,865,327 A * 2/1999 Johnston ..... B66C 19/02 104/126
6,062,404 A * 5/2000 Erdmann ..... B66C 23/708 212/292
6,189,712 B1 * 2/2001 Conrad ..... B66C 23/705 212/292
6,213,318 B1 * 4/2001 Walker ..... B66C 23/70 212/177
6,474,486 B1 * 11/2002 Baraniak ..... B66C 23/705 212/292
6,520,359 B2 * 2/2003 Richter ..... B66C 23/708 212/292
8,046,970 B2 * 11/2011 Diniz ..... E04H 12/10 52/123.1
8,739,988 B2 * 6/2014 Walker ..... B66C 23/70 212/175
9,051,159 B2 * 6/2015 Walker ..... B66C 23/70
9,090,438 B2 * 7/2015 Krebs ..... B66C 23/708
2004/0238471 A1 * 12/2004 Lissandre ..... B66C 23/70 212/177
2005/0011850 A1 * 1/2005 Hinrichs ..... B66C 23/702 212/300
2008/0173605 A1 * 7/2008 Willim ..... B66C 23/70 212/177
2010/0326004 A1 * 12/2010 Daas ..... B66C 23/70 52/646
2011/0308189 A1 * 12/2011 Daas ..... B66C 23/70 52/646
2012/0031868 A1 * 2/2012 Willim ..... B66C 23/70 212/299
2012/0067840 A1 * 3/2012 Walker ..... B66C 23/70 212/177
2012/0085722 A1 * 4/2012 Willim ..... B66C 23/708 212/299
2012/0085723 A1 * 4/2012 Willim ..... B66C 23/72 212/350
2013/0168522 A1 * 7/2013 Daas ..... B66C 23/70 248/354.1
2014/0027398 A1 * 1/2014 Willim ..... B66C 23/365 212/177
2015/0203338 A1 * 7/2015 Albinger ..... B66C 23/70 52/651.07

* cited by examiner

TELESCOPIC BOOM AND CRANE

BACKGROUND OF THE INVENTION

This invention relates to a telescopic boom for a crane with at least two telescopable telescoping sections in the form of lattice pieces, each of which exhibits a hollow structure that has in essence the shape of a box.

A goal in the sector of wind power plants is to achieve very large hub heights for the wind wheels, in order to obtain a wind power on the rotor blades that is as homogenous as possible. Therefore, during the assembly of wind power plants the maximum achievable hub height represents a characteristic value for the required hoisting devices, usually mobile cranes having telescopic booms.

Because of the requirement to provide very large boom systems with large boom lengths, there is the problem that such dimensions make conventional telescopic booms too heavy. A significant reduction in weight can be obtained with lattice booms. However, telescopable booms have the advantage over conventional lattice booms that they can be quickly converted from a transport state into a working state and take up significantly less space during assembly. An additional advantage is that the total center of gravity of a crane with a long erected boom is very high, a feature that renders moving the crane to the construction site in the erected state extremely problematic or even impossible.

In order to combine the advantages of the above described types, suggestions for telescopable lattice booms have already been put forth. However, one difficulty with such telescopic booms is that of securing the extended adjacent telescoping sections in relation to each other for crane operations. Usually, securing is achieved by means of a plurality of pinned joints between the inner and outer telescoping section.

German document DE 20 2010 014 105 U1 discloses a pinning system for connecting the individual lattice elements of a telescopable lattice boom. In order to connect, all four corner struts of the lattice elements to be connected are pinned to each other. However, the drawback with the disclosed solution is that a high machining accuracy is necessary during the manufacture of the boom, in particular the pinning system, so that the resulting production costs are rapidly driven upwards.

SUMMARY OF THE INVENTION

An object of the present invention is to provide an alternative solution for a telescopable lattice boom, which can be manufactured at a lower cost and yet has an adequate load carrying capacity.

This object is achieved by means of a telescopic boom exhibiting the claimed features. Advantageous embodiments of the telescopic boom are also claimed.

According to the invention, a telescopic boom for a crane with at least two telescopable telescoping sections is proposed. Each of the at least two telescopable telescoping sections has a hollow structure that has in essence the shape of a box, so that an inner telescoping section can be supported in the cavity that is formed in the outer telescoping section and can be moved relative to said outer telescoping section. The term "inner and outer telescoping section" refers to a pair of telescoping sections formed. Each inner telescoping section can accommodate an additional section and, in relation to this additional section, is considered to be the outer section. An outer telescoping section can be supported in the cavity of at least one additional section and, in relation to this additional section, is called the inner section.

The boom system preferably is composed of a plurality of telescoping sections that can be supported one inside the other and can be telescoped out in the usual manner.

The inventive idea is to connect together these large sections, which can be telescoped into each other, after they have taken their intended position in relation to each other for normal crane operations. In the normal crane operating position the bottom chord of the individual telescoping sections is subjected to a compression force, and the top chord of each telescoping section is subjected to a tensile force.

Adjacent telescoping sections are connected to each other in accordance with the invention by way of their top chords and secured in relation to each other. For this purpose at least one pinning means is arranged on the bottom chord, in order to form a pinned joint that connects the two telescoping sections. At least some of the telescoping sections can have at least one pin retainer for the connection with an adjacent inner and outer telescoping section.

Furthermore, means are arranged in accordance with the invention on at least one of the telescoping sections, in particular, on the outer telescoping section, as a result of which at least some of the force that is introduced into the pinned joint can be dissipated into the top chord of the boom. This arrangement allows a uniform distribution of the force, i.e. in both the bottom chord and in the top chord, to be achieved with, for example, only a single pinned joint in the region of the bottom chord between adjacent telescoping sections. At variance with the state of the art, a single pinned joint between adjacent telescoping sections is sufficient to achieve, nevertheless, an optimal force transfer. A reduced number of necessary pinned joints suffices to erect the crane. This arrangement reduces the accruing production costs and the erection costs.

The absorbed force of the pinned joint is the normal force that acts in the longitudinal direction of the inner telescoping section. Furthermore, the arrangement in the bottom chord induces an additional moment that has a positive effect on the fixed end region and the bearing region between the inner and the outer telescoping section. The normal force, which engages with the pinned joint, and/or the moment can be distributed as uniformly as possible over the components of the telescoping section by means of the pinned joint and the means according to the invention.

The individual telescoping sections are, in one arrangement, telescopable lattice pieces. Hence, the resulting boom system permits a substantial saving in weight, as compared to conventional telescopic booms. As an alternative, the individual telescoping sections can be suitable constructions of sheet metal plate.

Ideally one or more telescoping sections can comprise shell-shaped corner struts that are connected to each other by means of lattice bars, in order to achieve the customary lattice structure of the lattice pieces known from the prior art. In particular, the customary triangular structure is achieved by means of the arrangement of the individual lattice bars at the shell-shaped corner struts.

A stable, loadable and simultaneously comparatively light structure can be advantageously provided by the connection of the corner struts, each of which forms the outer edges of the box-shaped hollow structure, to the lattice bars. This arrangement allows high or rather large heights of lift to be easily implemented without simultaneously having to accept an unacceptable weight increase.

In principle, it is conceivable that in addition to the lattice bars connecting the corner struts, one or more connection plates are used, so that the box-shaped hollow structure has closed outer walls at least in sections and not only the lattice bars, arranged in a half-timbered manner, at the lateral faces of the hollow structure.

Furthermore, it can be provided that the corner struts are configured so as to be edged and/or bent and/or are manufactured from tubular sections and/or from extruded profiles. With the use of semi-finished products it is advantageously possible to lower the cost of production and to ensure simultaneously the quality of the components that are used.

Ideally the means comprise one or more lattice bars that are connected to the pinned joint and that dissipate at least some of the force that is introduced into the pinned joint into the top chord. In particular, the specific dimensioning of the lattice bars that are used makes it possible to remove a relevant portion of the normal force from the bottom corner struts and to introduce said relevant portion of the normal force into the upper corner struts.

In a particularly advantageous embodiment at least one pinning means is designed as a pin retainer in the form of a sheet metal pinning plate with a passage opening. The pinning plate connects the two corner struts of the bottom chord of a telescoping section. One passage opening that is provided inside the pinning plate is used to receive or more specifically to feed through the connecting pin. It is particularly advantageous if the feed-through is arranged centrally between the corner struts.

In order not to introduce the normal force, which engages with the pinned joint, directly into the corner struts of the bottom chord of the telescoping section, the retainer of the pinned joint is designed to achieve a specific objective. For example, it is useful to design the pinning plate in such a way that it is elastic. In particular, the width of the pinning plate may taper off in the direction of the corner struts, a feature that results in an elastic behavior of the pinning plate.

In addition, the pinned joint or more specifically the pinning plate that is used may be connected to one or more corner struts of the bottom chord by means of one or more tension rods. Hence, the force acting on the pinned joint is introduced into the corner struts of the bottom chord by means of the pinning plate and the connected tension rods.

Furthermore, it is conceivable that the connecting point(s) of one or more of the aforementioned tension rods with the at least one corner strut of the bottom chord is and/or are connected by means of one or more compression struts to the top chord, in particular the one or more corner struts of the top chord. The applied tensile stress inside the tension rods of the bottom chord can be dissipated into the top chord by means of the compression struts.

In order to achieve the maximum extension length possible, the pinning means of the at least one inner telescoping section can be arranged at the end, i.e. on its end facing away from the boom. The pinning means of the inner telescoping section is preferably a pinning unit with a movable pin.

Each telescoping section has two ends: the collar on its outer end and the end piece on its inner end, i.e. the end facing the boom axis. Ideally the telescoping sections have on their outer end, which forms the surrounding telescoping section, a pin retainer in the form of a pinning plate with a passage hole, and provide on their end piece, which forms the inner telescoping section, a pinning unit, which is mounted preferably rigidly on the end piece and has a movable pin. This pin can be driven by an additional unit and can be inserted into the pin retainer of the outer telescoping section, i.e. into the passage hole of the pinning plate. The pin can be held preferably automatically in the connection position.

The pin that is used is inserted advantageously perpendicular to the defined surface area of the bottom chords. The pin is inserted accordingly perpendicular through the pinning unit and the pinning plate of the inner and outer telescoping section.

The fixed end region can be designed in such a way that it is stiffened. The fixed end region is defined as the region between the bearing points that connect the two telescoping sections to each other. Preferably each bottom chord and each top chord has four bearing points, i.e. two per corner strut. The distance between two bearing points per corner strut defines the fixed end region.

The stiffening of the inner and/or outer telescoping section optimizes the force distribution in the fixed end region. For example, it is conceivable that the fixed end region is configured with one or more stiffeners.

The telescopic boom according to the invention can have a guy rope that guys the booms completely or at least partially. When a guying frame is used, the boom system is connected to the superstructure by means of a luffing rope. It is also conceivable that the guy rope runs only as far as up to the second uppermost telescoping section, because this arrangement decreases the resulting unsupported length, over which buckling occurs, and the buckling load.

In addition, the invention relates to an individual telescoping section for the telescopic boom according to the invention. The telescoping section here is a lattice piece with a box-shaped hollow structure, and the telescoping section has a pin retainer as well as means for dissipating the force into its top chord. The advantages and properties of the telescoping section according to the invention correspond to those of the inventive telescopic boom, for which reason there is no need to discuss again the details at this point.

In addition, the invention relates to a crane, in particular a mobile crane, with the telescopic boom according to the invention. The advantages and properties of the crane according to the invention correspond to those of the inventive telescopic boom. The crane lends itself, in particular, to erecting wind power plants. The inventive nature of the boom system permits a high boom length and an extremely steep angle position of the boom system, as a result of which particularly high heights of lift can be realized.

Additional advantages and details of the invention are explained in detail below with reference to the drawings.

DETAILED DESCRIPTION OF THE DRAWINGS

Figure 1A:
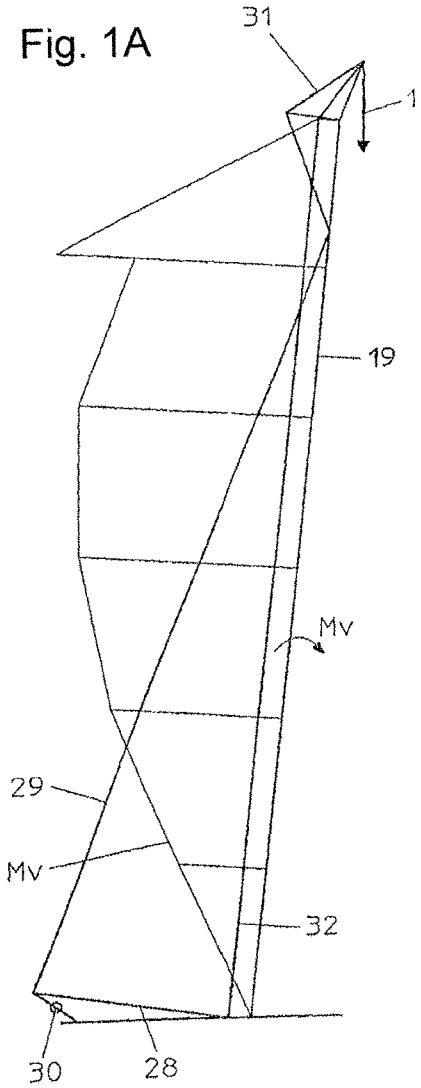
FIGS. 1A and 1B are schematic representations of a crane for the purpose of explaining the internal forces and moments induced by the attacking forces.

To begin with, the forces acting on a crane shall be briefly explained by means of the presentation of FIG. 1A. FIG. 1A shows a boom 19 and a moment Mv, which has been plotted along the boom 19 and which is induced by a load lift. The figure shows that the boom 19 is reduced to a bar, because from a static perspective it is customary to show the amount of a moment acting on a bar in a diagram, where the X axis is defined by the bar. For the sake of completeness the effective direction of the moment is indicated.

Therefore, the moment Mv shows the moment that acts on the bar at a certain distance from the luffing axis of the boom. This can be called the global moment, at which the design of the boom 19 is not considered. As a result, it may involve not only a telescopable boom, but also a boom that is assembled from individual elements. Even the method for luffing the boom 19 is irrelevant.

The telescopable boom 19 according to the invention involves a large telescopable lattice boom of individual lattice pieces that can be telescoped in or out in the customary way. The drawing according to FIG. 1A shows the boom 19 in the extended position. The guying system 29, the boom 19 and the guying frame 28 form a defined triangle. The guying system 29 is adapted to the respective boom length and, as a result, is length variable. The luffing angle is adjusted by pulling in or letting out the luffing rope 30, which runs from the guying frame 28 to the superstructure of the crane. In this way the aforementioned triangle is luffed as a whole. However, as an alternative, the luffing can also be performed by means of a luffing cylinder.

A typical wind power tip 31 is attached to the boom head. The hoisting rope is marked with the reference numeral 32. In order to optimize the design of the load on the boom, the guying system 29 is not run up to the boom tip, but rather ends at the tip of the second uppermost telescoping section. This arrangement reduces the load with respect to a potential buckling, because the entire unsupported length, over which buckling occurs, is shortened. Each defined extension length of the boom 19 is assigned a specific length of the guying system 29.

Furthermore, FIG. 1A shows the moment Mv, which is induced by the load 1, on the boom 19. Starting at the boom tip, this moment increases linearly at first, because the guying system 29 is fastened only at the end of the second uppermost telescoping section. Then after the engagement point of the guying system 29, the moment Mv decreases until it reaches the zero value at the pivot axis of the boom 19. The compression force occurs on the underside of the boom (bottom chord), i.e. the side of the boom that faces the load, whereas a tensile force is applied at the opposite top side (top chord) of the boom 19.

The attacking moment Mv leads to a deflection of the boom 19 and to a resulting lever arm of the normal force $F_N$. Both are transmitted from the respective inner telescoping section into the adjacent outer telescoping section. The place of the transmission is referred to as the so-called fixed end region that is defined by the distance between the bearing points of the inner telescoping section in the cavity of the outer telescoping section. The force ratios in the fixed end region are referred to as the locally occurring moments and depend on the concrete geometry of the structure of this fixed end region or more specifically on the connection of the adjacent telescoping sections.

Working on this basis, the resulting total load on the boom 19 is made up of the global moment Mv and the respective local moments in the individual fixed end regions of the specific number of sections of the telescopic boom.

Figure 2:
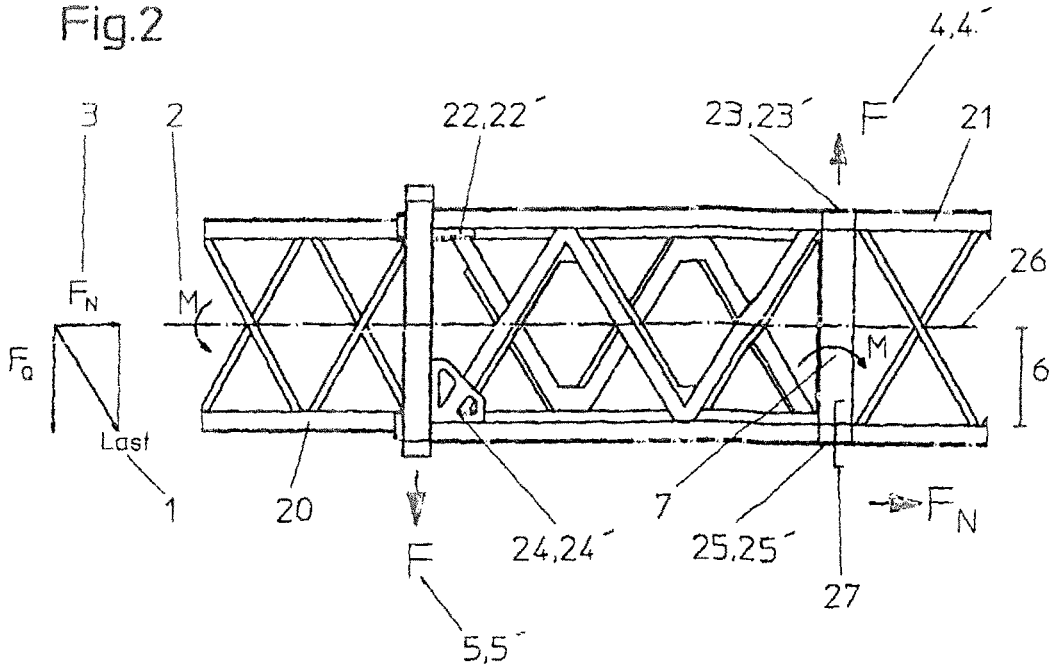
FIG. 2 is a detailed illustration of the inventive telescopic boom with two telescoping sections that are supported one inside the other.

The purpose of FIG. 2 is to elucidate once again the force ratios in the fixed end region of two adjacent sections of the telescopic boom that are connected to each other in accordance with the technical teaching of the invention. The drawing shows a side view of an inner telescoping section 20, which is mounted in the box-shaped cavity of the outer telescoping section 21 by means of the bearing points 22, 22', 23, 23', 24, 24', 25, 25'.

The load 1 produces in the inner telescoping section 20 a moment M and a normal force $F_N$ in the longitudinal direction of the inner telescoping section 20. The inner telescoping section 20 passes both the moment and the normal force into the outer telescoping section 21, so that the normal force $F_N$ is a compression force and acts in the longitudinal direction in the center axis 26 of the inner telescoping section 20. The moment M can be divided into a pair of forces, each of which is in a plane parallel to the luffing plane. The bearing points 22, 23, 24 and 25 enclose a first plane, whereas the bearing points 22', 23', 24', and 25' enclose a second plane. Hence, a force F 5 acts in the bearing point 24; and a force F 5' acts in the bearing point 24' respectively. The associated force F 4 acts in the bearing point 23; and the force F 4' acts in the bearing point 23'. The forces depend more or less on the distance between the bearing points 23, 24.

In a first step the related forces F4, 4' and F 5, 5' respectively are assumed to have the same magnitude. At this point these forces are superimposed with the following effect that is induced by introducing the normal force $F_N$ from the inner telescoping section 20 into the outer telescoping section 21. The normal force $F_N$ acts in the center axis 26 and is transmitted by means of the pinned joint 27 to the two bottom chords of the telescoping sections 20, 21. Hence, this normal force $F_N$ causes a counter-moment, which counteracts the applied moment M, over the distance 6 between the center axis 26 and the pinned joint 27. The counter-moment 7 can also be divided into a pair of forces that counteract the forces F 4, 4', 5, 5' respectively and, in so doing, minimize them.

Figure 1B:
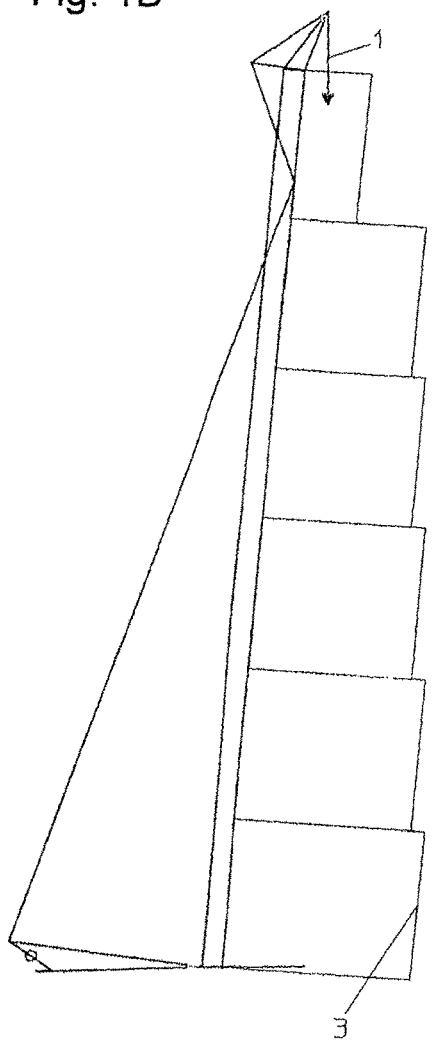

FIG. 1B shows the normal force $F_N$ that is to be absorbed in the respective pinned joints 27 between the individual telescoping sections of the boom 19. The normal force $F_N$ is induced more or less by the load 1 over the outermost telescoping section, i.e. in the region of the boom tip. The force increases suddenly, when the holding force of the guying system 29 also enters into the calculation. In this case it is essential for the invention that the normal force $F_N$ be a compression force. However, in theory the normal force could also be assumed to be the tensile force, provided that the moment were to act in the opposite direction to the moment Mv.

In order to optimize the load applied to the fixed end region of the pairs of telescoping sections 20, 21 and in order not to increase over-proportionally by means of the bottom chord pinning the pressure that is already being applied to the bottom chords in any event, in addition to the pinned joint 27, additional measures are taken; and these additional measures shall be described below with reference to FIGS. 3 and 4.

Figure 3:
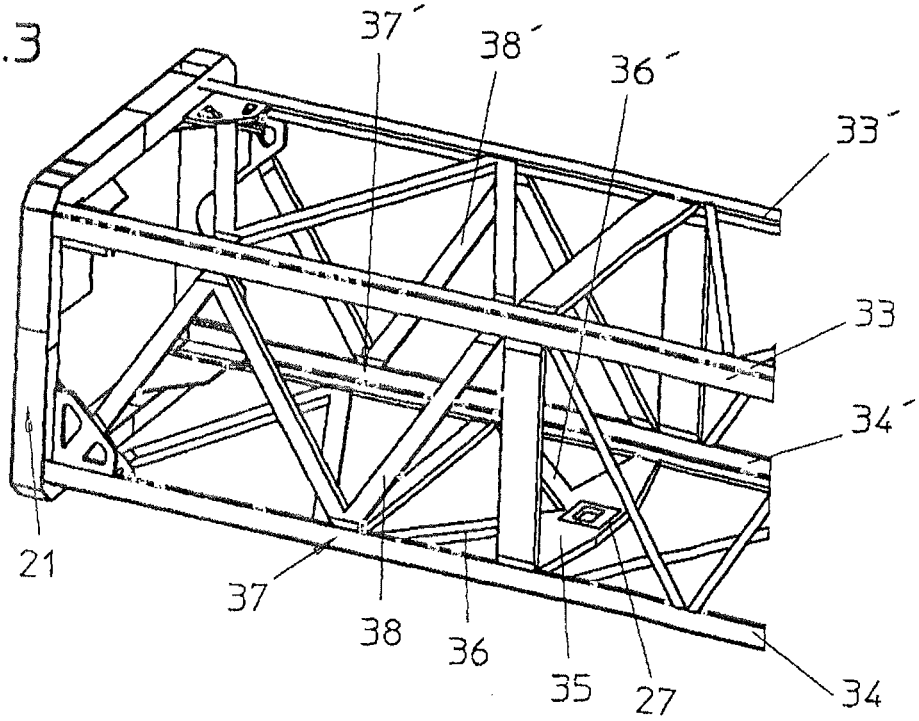
FIG. 3 is a perspective side view of the outer section of the telescopic boom shown in FIG. 2.

FIG. 3 shows the construction of the outer telescoping section 21 in a perspective side view. The telescoping section 21 corresponds in essence to a lattice element with a hollow structure in the shape of a box. The corners or rather the edges of the box shape are formed by the shell-shaped corner struts 33, 33', 34, 34'. The individual corner struts are connected to each other by means of a plurality of tension rods 36, 36' and compression struts 38, 38', collectively referred to as lattice bars. In this case the individual lattice bars are arranged in a manner shown that allows the formation of a structure that is advantageous in terms of the statics of the lattice elements.

In addition to the lattice bars connecting the corner struts, individual sheet metal connection plates 35 are provided, so that the box-shaped hollow structure has closed outer walls at least in sections and not only the lattice bars, arranged in a half-timbered manner, at the lateral faces of the hollow structure.

The bottom chord of the outer telescoping section that is shown is formed by the surface area defined by the bottom corner struts 34, 34'. The sheet metal plate 35, which connects the two corner struts 34, 34' in the plane of the bottom chord, has a pin retainer 27 with a continuous bore hole. In order to connect, a single pin is inserted transversely to the surface of the sheet metal connection plate 35.

A key aspect of the invention for its successful implementation consists of the fact that the normal force $F_N$ be transmitted as uniformly as possible to the corner struts 33, 33', 34 and 34'. Without special measures the bottom corner struts 34, 34' would be subjected to considerably more stress from the inner telescoping section or more specifically the outgoing normal force $F_N$ than the upper corner struts 33, 33'. In order not to introduce the normal force $F_N$ immediately into the corner struts 34, 34', the retainer of the pinned joint 27 is designed to achieve the objective that the width of the sheet metal plate 35 tapers off in the direction of the corner struts 34, 34'. Owing to this arrangement the sheet metal plate acquires elastic properties. However, the tension rods 36, 36', which meet at the sheet metal plate 35 in the region of the pin retainer 27 and connect said pin retainer to the corner struts 34, 34', are put under tensile stress by means of the rationally designed deformation.

The tension rods 36, 36' are connected to the corner struts 34, 34' in the connecting nodes 37, 37'. In order to remove the force in the top chord, the connecting nodes 37, 37' are connected by means of compression struts 38, 38' to the top chord of the telescoping section, in particular to the two corner struts 33, 33' of the top chord. By rationally designing the nodes 37, 37' and by suitably dimensioning the compression struts 38, 38', a relevant portion of the normal force $F_N$ can be removed from the bottom corner struts 34, 34' and can be introduced into the upper corner struts 33, 33'.

Furthermore, a stiffer fixed end region may facilitate the uniform introduction of the forces into all four corner struts. For this purpose the fixed end region could also be constructed in the form of a box with stiffeners.

Figure 4:
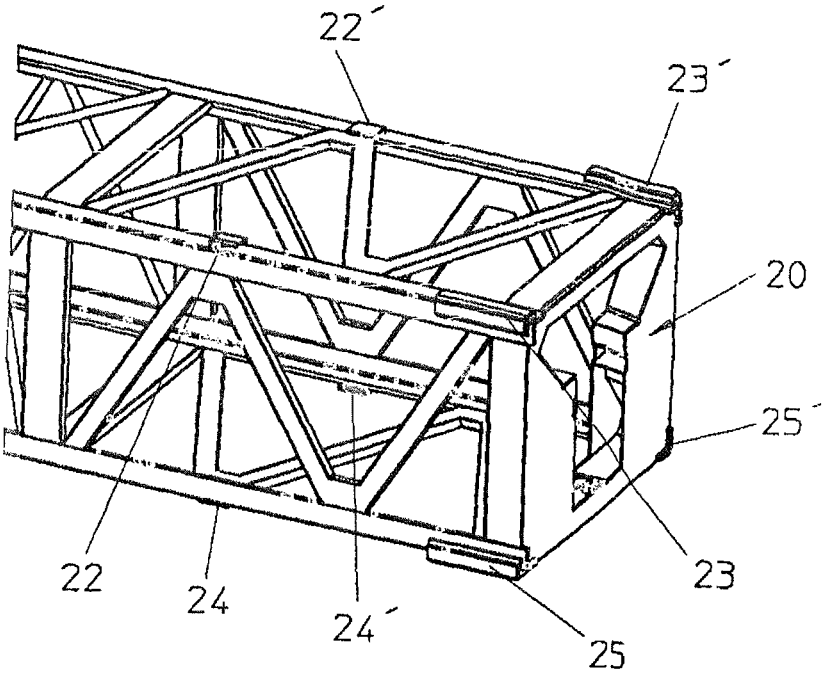
FIG. 4 is a perspective side view of the inner section of the telescopic boom shown in FIG. 2.

FIG. 4 shows the configuration of the inner telescoping section 20. It is clear from the perspective side view that the telescoping section also comprises four sheet metal plates on its end region, i.e. that end facing away from the boom axis. In this case the pinning plate that extends in the plane of the bottom chord has a pinning unit with a movable pin. In order to pin the outer telescoping section, the pin can be inserted through the bore hole of the pin retainer 27.

So-called bearing points 22, 22', 23, 23', 24, 24', 25, 25' are arranged on the outer edge of the individual corner struts 33, 33', 34, 34; in so doing, the inner telescoping section 20 is mounted in the cavity of the outer telescoping section 21 in such a way that the inner telescoping section can be displaced. Although the term "corner strut" is used, this element may also be, as an alternative, an angle bracket or a bent sheet metal plate. Additional types of designs are just as conceivable in order to transmit the normal force $F_N$ from the bottom chord, or more specifically the pinned joint 27, into the top chord. It should always be provided by means of suitable measures that some of the force that is transmitted from the pin be transmitted into the top chord.

The invention claimed is:

1. A telescopic boom for a crane comprising:

at least two telescopable telescoping sections formed as lattice pieces, each of which exhibits a box-shaped hollow structure, the sections having bottom corner struts defining first surface areas at an underside of the boom facing a load during normal crane operations, as well as top corner struts defining second surface areas at a top side of the boom opposite to the underside of the boom;

a pinned joint provided to the first surface areas of adjacent sections of the telescoping sections at the boom underside, the pinned joint provided in order to pin the first surface areas of the adjacent sections at the boom underside to each other during the normal crane operations; and tension rods and compression struts, arranged on an outer section of the at least two telescoping sections, each of the tension rods having one end connected to a pin retainer of the pinned joint at the underside of the boom and another end connected to one of the bottom corner struts, each of the compression struts extending between and connecting the underside and the top side of the boom, wherein at least some force introduced into the pinned joint is dissipated by way of the tension rods and the compression struts into the top corner struts of the boom.

2. The telescopic boom as claimed in claim 1, wherein the pin retainer is in the form of a sheet metal pinning plate with a passage opening and the pinned joint connects two adjacent bottom sections of the telescoping sections together.

3. The telescopic boom as claimed in claim 2, wherein the pinning plate has a width that is tapered off in a direction of the corner struts.

4. The telescopic boom as claimed in claim 3, wherein the pinning plate is connected to at least one of the bottom corner struts by a pair of said tension rods.

5. The telescopic boom as claimed in claim 4, wherein at least one connecting point of one of the tension rods to the at least one bottom corner strut is connected by one of the compression struts to one of the top corner struts.

6. The telescopic boom as claimed in claim 1, wherein the pinned joint includes a connecting plate to receive a movable pin.

7. The telescopic boom as claimed in claim 6, wherein the pin is guided perpendicular to a defined surface area through the connecting plate.

8. The telescopic boom as claimed in claim 1, wherein the boom has a fixed end region that is stiffened.

9. The telescopic boom as claimed in claim 1, wherein the corner struts are configured so as to be at least one of edged, bent, and manufactured from tubular sections, extruded profiles, or both tubular sections and extruded profiles.

10. The telescopic boom as claimed in claim 1, wherein the boom is guyed by a guying system that connects the boom to a guying frame.

11. A telescoping section for a telescopic boom as claimed in claim 1.

12. A mobile crane for assembly of a wind power plant comprising a telescopic boom as claimed in claim 1.

13. A mobile crane for assembly of a wind power plant comprising a telescopic boom as claimed in claim 6.

14. A mobile crane for assembly of a wind power plant comprising a telescopic boom as claimed in claim 8.

15. A mobile crane for assembly of a wind power plant comprising a telescopic boom as claimed in claim 10.

* * * * *